United States Patent [19]

Best

[11] 4,280,559

[45] Jul. 28, 1981

[54] METHOD FOR PRODUCING HEAVY CRUDE

[75] Inventor: Donald A. Best, Calgary, Canada

[73] Assignee: Exxon Production Research Company, Houston, Tex.

[21] Appl. No.: 88,905

[22] Filed: Oct. 29, 1979

[51] Int. Cl.[3] ..... E21B 43/24

[52] U.S. Cl. ..... 166/303; 166/305 R

[58] Field of Search ..... 166/303, 263, 272, 261

[56] References Cited

U.S. PATENT DOCUMENTS

| | | | |
|---|---|---|---|
| 3,354,958 | 11/1967 | Parker | 166/303 |
| 3,881,550 | 5/1975 | Barry | 166/303 X |
| 4,022,277 | 5/1977 | Routson | 166/303 X |
| 4,034,812 | 7/1977 | Widmyer | 166/303 |
| 4,130,163 | 12/1978 | Bombardieri | 166/263 X |
| 4,133,382 | 1/1979 | Cram et al. | 166/263 |

*Primary Examiner*—Stephen J. Novosad

*Attorney, Agent, or Firm*—Michael A. Nametz

[57] ABSTRACT

A process for the in situ recovery of viscous oil from a subterranean formation is disclosed. Steam is injected into the formation via a well, permitted to soak, and heated fluids including heated viscous oil are produced sufficient to create a substantial fluid mobility in the formation. Then a hydrocarbon solvent having a low concentration of low molecular weight paraffinic hydrocarbons is injected into the formation, and another steam injection, soak and oil production cycle is performed to recover significant additional quantities of oil.

17 Claims, 3 Drawing Figures

2
1
4
6
7
5
STEAM
CHAMBER
3

SOLVENT: LIGHT CAT NAPHTHA
(BOILING RANGE-80°F TO 350°F)
STEAM ONLY
104G OF SOLVENT
92G OF SOLVENT
OIL PRODUCTION (CCS)
500
400
300
200
100
0
0
4
8
12
16
20
CYCLE NUMBER

METHOD FOR PRODUCING HEAVY CRUDE

BACKGROUND OF THE INVENTION

1. Field of the Invention

This invention relates to a process for extracting hydrocarbons from the earth. More particularly, this invention relates to a method for recovering viscous hydrocarbons such as bitumen from a subterranean reservoir by injecting a heated fluid via a well into the reservoir to lower the viscosity of the viscous hydrocarbons and to create fluid mobility, and by injecting a hydrocarbon solvent to assist in recovery of the viscous hydrocarbons.

2. Description of the Prior Art

In many areas of the world, there are larger deposits of viscous petroleum, such as the Athabasca and Cold Lake region in Alberta, the Jobo region in Venezuela, and the Edna and Sisquoc regions in California, U.S.A. These deposits are often referred to as "tar sand" or "heavy oil" deposits due to the high viscosity of the hydrocarbons which they contain. While some distinctions have arisen between tar sands, bitumen and heavy oil, these terms will be used interchangeably herein. These tar sands may extend for many miles and occur in varying thicknesses of up to more than 300 feet. Although these deposits may lie at or near the earth's surface, generally they are located under a substantial overburden which may be as great as several thousand feet thick. Tar sands located at these depths constitute some of the world's largest presently known petroleum deposits. The tar sands contain a viscous hydrocarbon material, commonly referred to as bitumen, in an amount which ranges up to about 20% by weight. Bitumen can be considered to be effectively immobile at typical reservoir temperatures. For example, in the Cold Lake region of Alberta, at a typical reservoir temperature of about 13° C. (about 55° F.), bitumen is immobile with a viscosity exceeding several thousand poises. However, at higher temperatures, such as temperatures exceeding 93° C. (about 200° F.), the bitumen generally becomes mobile with a viscosity of less than 345 centipoises.

Since most tar sand deposits are too deep to be mined economically, various in situ recovery processes have been proposed for separating the bitumen from the sand in the formation itself and producing the bitumen through a well drilled into the deposit. Among the various methods for in situ recovery of bitumen from tar sands, processes which involve the injection of steam are usually the first to be considered for application. Steam can be utilized to heat and fluidize the immobile bitumen and, in some cases, to drive the mobilized bitumen towards production means.

The most common and proven method for recovering viscous hydrocarbons is by using a steam stimulation technique, commonly called the "huff and puff" or "steam soak" process. In this type of process, steam is injected into a formation by means of a well and the well is shut-in to permit the steam to heat the bitumen, thereby reducing its viscosity. Subsequently, all formation fluids, including mobilized bitumen, water and steam, are produced from the same well using the previously injected steam as the driving force for production. Initially, sufficient pressure may be available in the production interval to lift fluids to the surface; as the pressure falls, artificial lifting methods are normally employed. Production is terminated when no longer economical and steam is injected again. This cycle is then repeated many times until oil production is no longer economical.

During the early cycles of steam injection and production, oil production rates may be quite high since the oil nearest to the well is being produced. However, during subsequent steam cycles as the oil nearest the well is depleted, steam must move farther into the formation to contact the oil and as a result increased heat losses make the steam less effective as an oil recovery agent. The process loses efficiency and eventually oil production becomes uneconomic.

Another general method for recovering viscous hydrocarbons is by using "thermal drive" processes. Such processes employ at least two wells—an injection well and a production well, spaced apart from each other by some distance and extending into the heavy oil formation. In operation, a heated fluid (such as steam or hot water) is injected through the injection well into the formation where it mixes with the heavy oil and drives the heated fluids toward the production well. A serious problem with thermal drive processes is that the driving force of the flowing heated fluid is lost upon break through at the production well. Moreover, because of the large reservoir volume which must be treated with the heated fluid, much of the heat value dissipates uselessly into the formation and is lost.

Various methods have been proposed for improving these thermal recovery processes. Many involve the injection of a nonaqueous solvent. For example, Canadian Pat. No. 1,036,928 granted to the Dow Chemical Company on Aug. 22, 1978 discloses a process which involves injecting hot solvent vapors by themselves into a tar sand formation to recover only a portion of the oil. A very serious problem with this process it that to treat the large reservoir volumes with solvent alone would be prohibitively expensive.

Thus, others have proposed injecting solvent and steam. For example, U.S. Pat. No. 4,026,358 which issued on May 31, 1977 to Joseph C. Allen discloses a process which involves injecting a solvent followed by establishing a thermal sink in the formation by the injection of steam. Solvent is injected in this instance to improve the conformance of the thermal recovery method, i.e. to improve the horizontal and vertical sweep efficiencies. However, there is no assurance that by injecting solvent before injecting steam, the solvent will penetrate into the tar sand formation to a sufficient degree.

Yet another method disclosed in the patent literature is that disclosed in U.S. Pat. No. 4,034,812 which issued on July 12, 1977 to Richard A. Widmyer. This method involves injecting a heated fluid into the tar sand formation until the viscous petroleum is heated and physically separates in situ from unconsolidated sand. The sand then settles toward the bottom of a cavity created in the formation. Solvent is injected in order to assist in the separation of the viscous petroleum from the sand. However, those skilled in the art will recognize the difficulties of creating and sustaining an underground cavity that could be used for oil separation. If one were to establish such a cavity, problems may exist with this process in that prohibitively long periods of time may be necessary in order for the tar sands to separate. Further, during the time the bitumen is settling, heat is being dissipated and lost to the formation. The addition of a solvent prior to producing the oil is said to enhance the rate of separation of the sand from the oil.

While the above methods are of interest, the fact remains that this technology has not generally been economically attractive for commerical development of tar sands. Substantial problems exist with each process of the prior art. As mentioned, the only in situ process which has been proven to be effective commercially is the steam stimulation process and this process only recovers a small portion of the bitumen with declining effectiveness after each steam injection/production cycle. Therefore, there is a continuing need for an improved thermal process for the effective recovery of viscous hydrocarbons from subterranean formations such as tar sand deposits.

SUMMARY OF THE INVENTION

In accordance with the present invention, an improved steam stimulation recovery process is provided to alleviate the above-mentioned disadvantages. The process comprises cyclically injecting steam and producing oil from a heavy oil deposit until a substantial fluid mobility has been established in the deposit adjacent to the injection well. In practice, this means that at least one steam stimulation cycle will be required, and generally several cycles will be performed. Then, a slug of an appropriate hydrocarbon solvent is injected into the formation. The hydrocarbon solvent is a hydrocarbon fraction containing a low concentration of low molecular weight paraffinic hydrocarbons, and has a boiling point range for the most part less than the steam injection temperature and greater than the initial reservoir temperature. Steam is then injected, the formation is permitted to soak, and oil is produced as before. Surprisingly, injecting the proper hydrocarbon solvent only after the requisite fluid mobility has been created (comprising mostly steam or condensate), the amount of oil which is produced during subsequent steam injection/oil production cycles is greatly increased.

DETAILED DESCRIPTION OF THE INVENTION

Figure 1:
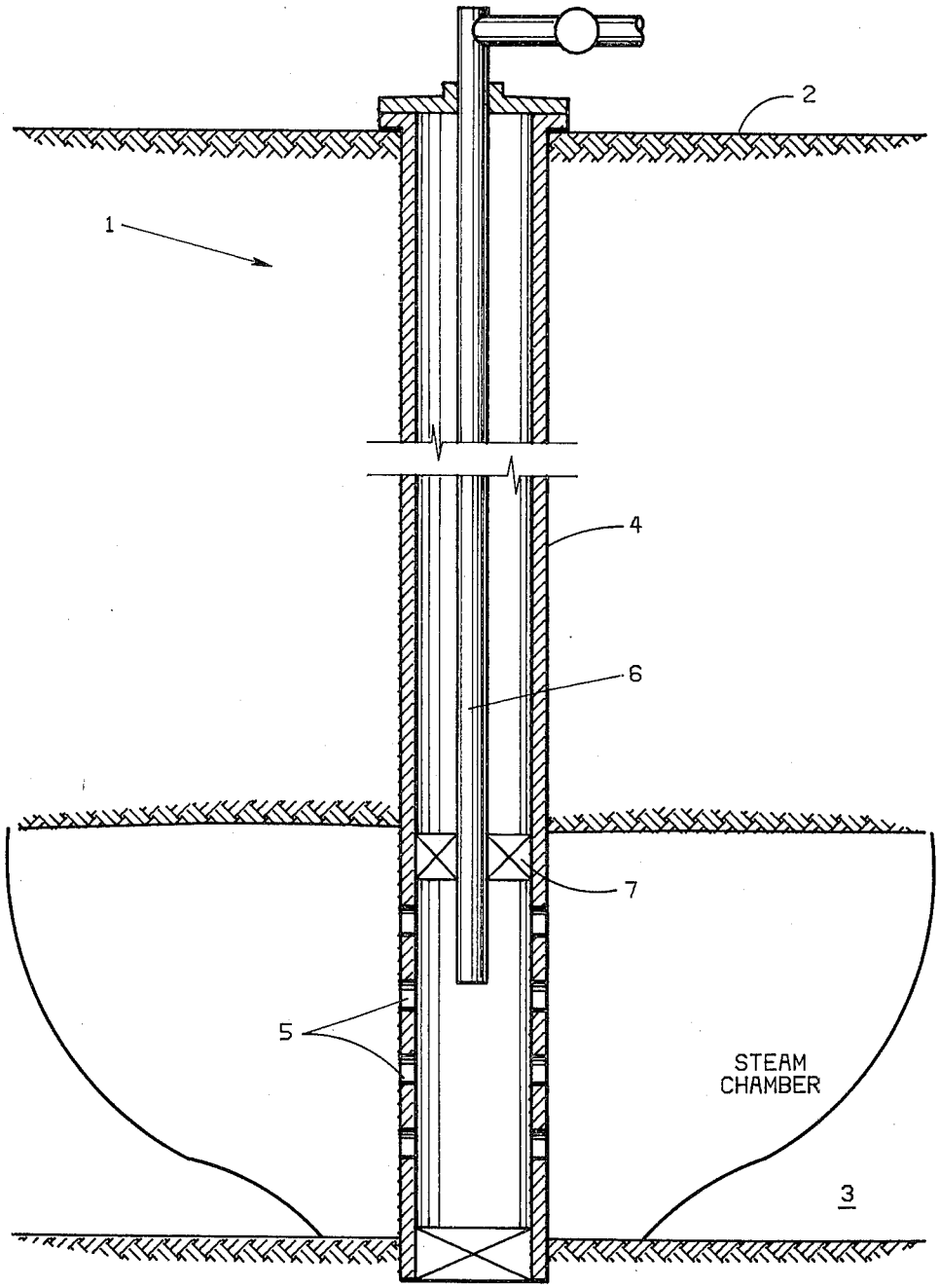
FIG. 1 schematically illustrates a well completion which penetrates a subterranean heavy oil formation.

The present invention is an improved steam stimulation process for recovering normally immobile viscous oil from a subterranean formation. Oil is recovered from a heavy oil formation by subjecting the formation to at least one cycle of steam stimulation (and preferably more than one) followed by injecting a slug of a hydrocarbon solvent prior to the next steam injection cycle. Solvent injection after at least one steam stimulation cycle (preferably more) is required so that a mobile gas phase saturation (usually steam) or a mobile liquid phase saturation (usually steam condensate) exists in the formation which promotes effective solvent/oil interaction.

In practice, the requisite minimum fluid mobility is achieved after one conventional steam stimulation cycle, preferably wherein at least 2000 liquid equivalent barrels of steam are injected. However, more cycles will frequently be performed until incremental oil production approaches uneconomic levels. Alternatively stated, the requisite fluid mobility will usually be established after at least 500 barrels of bitumen have been produced.

The hydrocarbon solvent contains low amounts of low molecular weight paraffinic hydrocarbons, and is preferably a mixed hydrocarbon fraction containing less than about 25 volume percent of paraffinic hydrocarbons having a molecular weight less than about 100. The preferred solvent has a boiling point range for the most part greater than the initial reservoir temperature and for the most part less than the steam injection temperature. The expression "for the most part" is used because suitable hydrocarbon solvents may have some components which boil above the steam injection temperature, and other components which boil below the initial reservoir temperature; however, a majority of the hydrocarbon components should preferably boil between these two temperatures. Also, the expression "initial reservoir temperature" means the temperature of the reservoir prior to conducting any steam stimulation cycles.

Thus, upon distillation, the preferred solvent will have a liquid volume percent residuum of at least about 5% and as much a about 100% at a distillation temperature corresponding to the initial reservoir temperature, and will have a liquid volume percent distillation yield of at least about 5% and as much as about 100% at a distillation temperature corresponding to about 75% of the steam injection temperature.

The method of the present invention is not applicable to a steam drive process; in other words, there should not be substantial interwell communication.

"Steam stimulation" is a method for thermally stimulating a producing well by heating the formation in the vicinity of the wellbore. As mentioned previously, this technique is often referred to as the "huff and puff" process, and has also been referred to as a "steam soak" or "push-pull" process. In general, a steam stimulation process comprises a steam injection phase, a brief shut-in period, and an oil production phase. Typical steam injection volumes range from 2,000–60,000 bbls. The primary objective of a steam stimulation process is to transport thermal energy into the formation and permit the rock and reservoir fluids to act as a heat exchanger. This heat then lowers the viscosity of the oil flowing through the heated volume. Normally, water-oil ratios are quite high when the well is first returned to production, but the amount of water produced quickly declines and the oil production rate passes through a maximum that is usually much higher than the original rate. As the formation cools, the productivity declines and approaches its original value.

Each steam injection, soak, and oil production cycle can be and is often repeated for a given formation. It is not uncommon for a well to undergo ten or more steam stimulation cycles. However, it has been the general experience that oil-steam ratios will decrease with successive cycles. The reason for this is that with each successive cycle, recoverable oil becomes depleted farther and farther from the well. Steam must therefore move increasingly farther into the formation to contact more oil. In so doing, increased heat losses are incurred to the overburden, the underburden, and to the reservoir itself (including both the rock and reservoir fluids cooled during the previous production phase). This causes greater quantities of steam to condense, making it less effective as an oil recovery agent. The process losses efficiency, oil production declines and eventually the operation becomes uneconomic. Nevertheless, in almost every case a substantial residual oil saturation will exist in the volume of the formation already treated by the steam. This residual oil saturation may be as high as 99% of the original oil in place, and will typically range from about 20% to about 85%.

The method of the present invention significantly improves the amount of oil which can be ultimately recovered from the formation volume which has already been treated, contacted or otherwise affected by injected steam.

FIG. 1 illustrates a well completion for practicing the present invention, although the present invention should not be limited to this particular well completion. A well 1 is extended from the surface 2 to the bottom of heavy oil formation 3. The well is completed with a casing or liner 4 having perforations 5 (or other communication means, such as slots) over the thickness of the formation 3. An injection/production tubing string 6 is concentrically located within the casing 4 and terminated above the bottom of formation 3. A suitable well packer 7 isolates the annular space between the tubing string 6 and the casing 4.

Steam is injected into the formation 3 via tubing string 6, preferably at the highest practical injection rates. Generally, the injection pressure will approach the formation fracture pressure. Next, the well 1 is shut in and the formation is permitted to "soak" during which time heat is transferred from the steam to the otherwise immobile heavy oil thereby reducing its viscosity. The time period of the soaking step is generally on the order of a few days, and is governed primarily by the need to strike a balance between avoiding excessive production of steam against excessive heat losses. Following the soak period, the well is opened again and mobilized oil is produced back through the tubing string 6.

The reservoir fluids initially produced from the well will usually be hot aqueous fluids. Later, the oil is produced at a rate typically four or five times the original rate. The rate of high oil production can last anywhere from one month up to six or more months and then the rate declines sharply. When the production rate is no longer economic, a second steam stimulation cycle is initiated. These steam stimulation cycles are repeated until the process is no longer efficient.

After one cycle, a steam saturated volume, also referred to herein as a "steam chamber", will have formed in the formation 3 and will increase in size with subsequent steam stimulation cycles. The steam chamber will have a relatively high mobile fluid saturation, either steam or steam condensate or both. This mobile fluid saturation may also contain small amounts of hydrocarbons. This saturation will generally correspond to the cumulative volume of oil produced during the previous cycle or cycles. The steam chamber volume may range from about 70 $m^3$ after one steam stimulation cycle to about $34\times10^3$ $m^3$ after ten cycles. The creation of this mobile fluid saturation in the formation is a key to the practice of this invention.

Then a slug of hydrocarbon solvent is injected into the formation prior to the next steam stimulation cycle. The solvent having the preferred characteristics will vapourize during injection into the previously steam stimulated formation but will not vapourize in significant amounts during subsequent production. As mentioned, the preferred solvent consists of a hydrocarbon mixture of which at least 5% and as much as 100% is recovered as distillate ("yield") when distilled according to standard ASTM distillation procedures to a temperature corresponding to about 75% of the injected steam temperature, and at least 5% and as much as 100% residuum is obtained at a distillation temperature corresponding to initial reservoir temperature. Further details on the distillation procedure may be found in ASTM D 86-67 (reapproved 1972), "Standard Method of Test for Distillation of Petroleum Products". Equivalent standards are American National Standard Z11.10-1973 (R-1968), Deutsche Norm DIN 51 751, and British Standard 4349.

The quantity of the solvent injected can be determined by the cumulative quantity of bitumen produced during previous steam stimulation cycles. The quantity of solvent can range from less than 1 liquid volume percent (LV%) of the cumulative bitumen produced to as much as 100%. The preferred quantity is between 5 LV% and 15 LV%.

After injecting the solvent slug, the normal quantity of steam is injected into the formation. Following a soak period, oil is produced via tubing string 6 as usual. The amount of oil recovered from the steam chamber is significantly increased, typically from about 3 to about 15 times greater than what would have been predicted with steam injection along. Generally, the barrels of oil produced per barrel of solvent injected will range from about 2 to about 8.

As indicated, it is believed that the reason for significantly increased oil recovery is that a mobile fluid saturation has been created in the formation before solvent is injected. While not wishing to be bound by theory, it is hypothesized that this causes a shift in the mechanism of solvent-oil interaction from that which might otherwise occur if the mobile fluid saturation were not present. When solvent is injected into a formation before a mobile fluid saturation has been established, it is believed that molecular diffusion is the primary mechanism in which concentration gradient is the dominant driving force. Since this form of mass transfer is exceedingly slow, the rate of dilution and consequently the rate of viscosity reduction will be slow. Thus, while oil production may be enhanced somewhat, the degree of enhancement is often not enough to offset the cost of the solvent. However, once a mobile fluid saturation has been created as in the present invention, the movement of solvent into the formation is believed to take place via bulk transfer (Darcy flow). Significant convective mixing with the oil phase is then possible. The dilution of the oil phase by the solvent also results in swelling of the oil, tending to increase oil displacement efficiency during subsequent production.

Various hydrocarbon solvents may be used to advantage in practicing the method of this invention, including light naphtha, gasoline, and aromatic solvents including but not restricted to benzene, toluene, xylene. The basic criterion is that the solvent have an acceptable solubility in the heavy oil at reservoir temperature and pressure. In general, this solubility is achieved with the preferred solvents containing low concentrations of low molecular weight paraffinic hydrocarbons. As mentioned, it is especially preferred to use a hydrocarbon solvent with the distillation residuum and yield discussed previously. This solvent can be conveniently obtained through conventional refining practices, e.g.

from a crude upgrading plant which involves conventional fluid coking and coke gasification processes. For example, recovered bitumen is preheated and fed to a fluidized bed reactor to form a mixed hydrocarbon vapour and coke. The hot vapours are then fractionated. One fractionated hydrocarbon stream is light naphtha which boils over the desired temperature range. The product stream could be further refined and cracked, e.g. to arrive at an especially preferred light cracked naphtha fraction boiling over a 25°-175° C. (about 80°-350° F.) temperature range. However, the decision whether or not to perform such additional steps is based primarily on economics. These refining steps are generally well-characterized and will be known by those skilled in the art.

Because of its high heat content per pound, steam is ideal for raising the temperature of a reservoir in a thermal stimulation process. Saturated steam at 175° C. (350° F.) contains about 1190 btu per pound compared with water at 175° C. (350° F.) which has only 322 btu per pound or only about one-fourth as much as steam. The big difference in heat content between the liquid and the steam phases is the latent heat or heat of evaporation. Thus, the amount of heat that is released when steam condenses is very large. Because of this latent heat, oil reservoirs can be heated much more effectively by steam than by either hot liquids or non-condensable gases.

Several factors affect the volume of steam injected. Among these are the thickness of the hydrocarbon-containing formation, the viscosity of the oil, the porosity of the formation, amount of formation face exposed and the saturation level of the hydrocarbon, water in the formation and the fracture pressure. Generally, the steam volume injected in each steam stimulation cycle will vary between about 2000 and about 60,000 barrels. Pressures are usually within the range of about 1000 to about 2000 psig, preferably 1100 to 1600 psig. During the oil recovery phase, pressures decline to atmospheric pressure.

Generally, in most field applications the steam will be wet with a quality of approximately 65 to 90 percent, although dry or slightly dry or slightly superheated steam may be employed. An important consideration in the choice of wet rather than dry steam is that it may be generated from relatively impure water using simple field equipment. The quantity of steam injected will vary depending on the conditions existing for a given reservoir.

In general, the mechanics of performing the individual steps of this invention will be well known to those skilled in the art although the combination has not heretofore been recognized. Further, it should be recognized that each reservoir will be unique. The number of stimulation cycles before solvent slug injection will depend upon a number of factors, including the quality of the reservoir, the volume of steam injected, the injection rate and the temperature and quality of the steam. Further details on steam stimulation processes may be found in the following references: S. M. Farouq Ali, "Current Status of Steam Injection as a Heavy Oil Recovery Method", Journal of Canadian Petroleum Technology, Jan.-Mar., 1974; G. H. Kendall, "Importance of Reservoir Description in Evaluating In Situ Recovery Method for Cold Lake Heavy Oil, Part I—Reservoir Description", The Petroleum Society of C.I.M., Paper No. 7620, presented at the 27th Annual Technical Meeting in Calgary, June 7-11, 1976; D. E. Towson, "Importance of Reservoir Description in Evaluating In Situ Recovery Methods for Cold Lake Heavy Oil, Part II—In Situ Application", Petroleum Society of C.I.M., Paper No. 7621, presented at the 26th Annual Technical Meeting in Calgary, June 7-11, 1976.

EXPERIMENTAL

Laboratory results confirm that significant improvement in oil recovery is obtained through the practice of this invention. In a typical experiment, a 4-foot × 6-inch I.D. cylindrical vertical model was packed with a synthetic tar sand to a density of 1.86 grams/cc. The tar sands consisted of about 18 weight % dewatered Cold Lake bitumen, 77 weight % 3/0 inspected quartz sand and 5 weight % water. This synthetic mixture was packed into the vertical model using a 600 psi hydraulic ram. Coarse sand was packed into the bottom of the model to a depth of approximately 4 inches to minimize end effects during subsequent production. The entire model was insulated so that it could be operated in an adiabatic fashion. The initial synthetic tar sand temperature of the model was 23.9° C. (about 75° F.) for each experiment. Concentric tubing corresponding to an injection/production well was installed at the bottom of the model. Steam or solvent was injected through the inner tubing while produced fluids were extracted through the outer annulus.

Four groups of experiments were conducted. In each experiment, a freshly packed model was subjected to ten cycles of steam stimulation by injecting dry steam at 400 psi. (steam temperature of about 227° C. or 440° F.) for 15 minutes followed by a 15 minute production period.

In Group I experiments, steam stimulation was continued in subsequent cycles as usual. In Group II experiments, a slug of solvent (Coker C4) having relatively high concentrations of low molecular weight paraffinic hydrocarbons, and also having a residuum of less than 5% at a distillation temperature corresponding to the initial tar sand temperature (75° F.), was injected in Cycle 11 ahead of the steam. In Group III experiments, a slug of solvent having low concentrations of low molecular weight hydrocarbons, and also having a residuum of greater than 5% at a distillation temperature equal to the initial tar sands temperature and a yield of greater than 5% at a temperature equal to 75% of the steam injection temperature (about 170° C. or 330° F.), was injected in Cycle 11 ahead of the steam. In Group IV experiments, a slug of solvent (heavy naphtha) having a yield of less than 5% at a distillation temperature corresponding to 75% of the steam injection temperature was injected in Cycle 11 ahead of the steam. Thus, only Group III experiments utilized solvents meeting the paraffinic hydrocarbon requirement, and both the yield and residuum conditions. The Group II solvent failed to meet both the paraffinic hydrocarbon requirement and the residuum condition, while the Group IV solvent failed to meet the yield condition.

Figure 2:
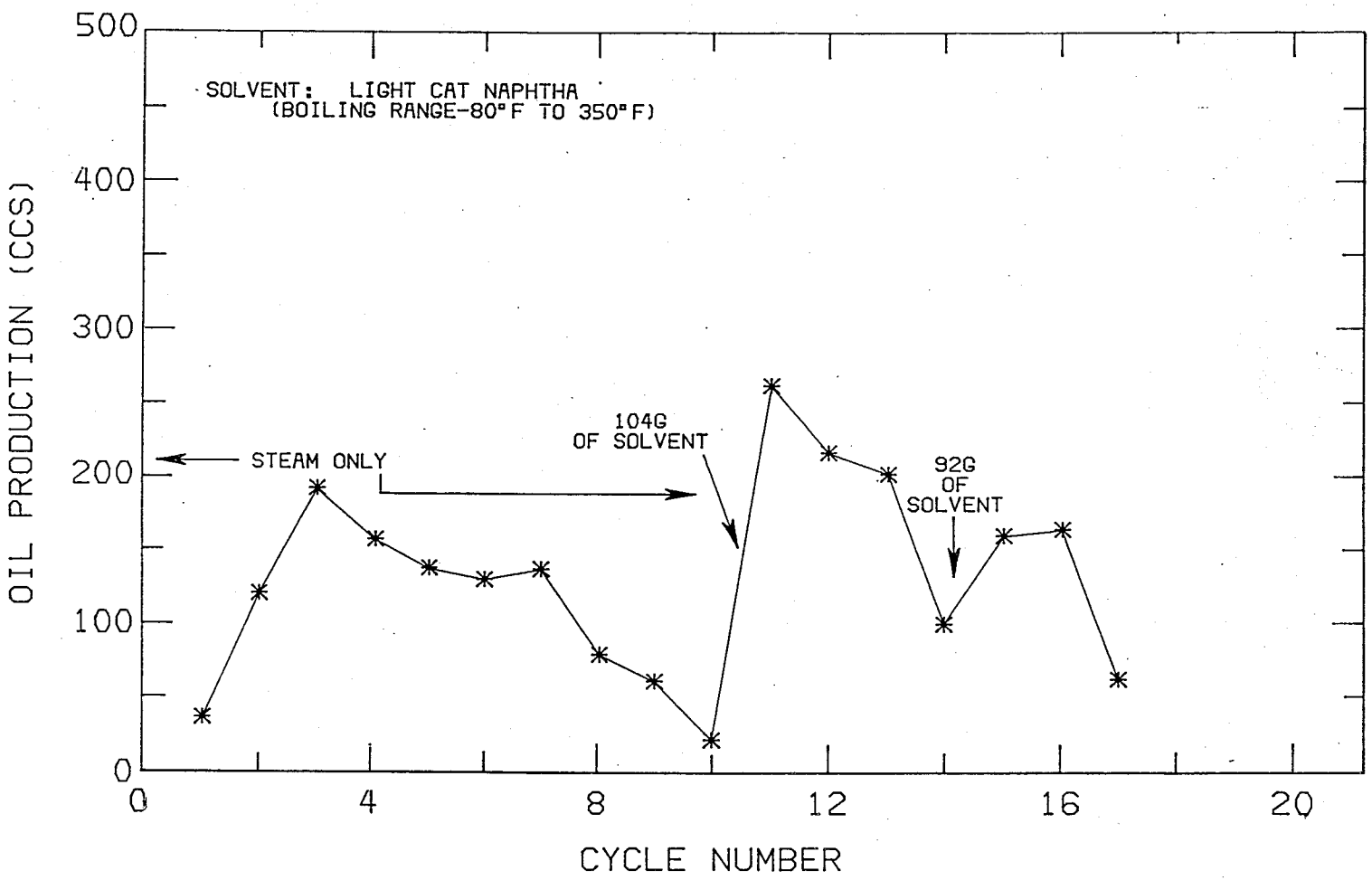
FIG. 2 is a plot illustrating the increased oil production using a light cracked naphtha solvent.

FIG. 2 illustrates the superior results obtained in one representative experiment by practicing this invention using a Group III solvent, a light cracked naphtha fraction boiling for the most part over an 80°-350° F. temperature range. As may be seen from FIG. 2, oil production after 10 cycles had drastically declined. Continued steam stimulation would ordinarily not be warranted. Thus, prior to injecting the eleventh slug of steam, a 104 g slug of a light cracked naphtha (boiling range 80°-350° F.) was injected into the model. Oil production was immediately and significantly improved.

Figure 3:
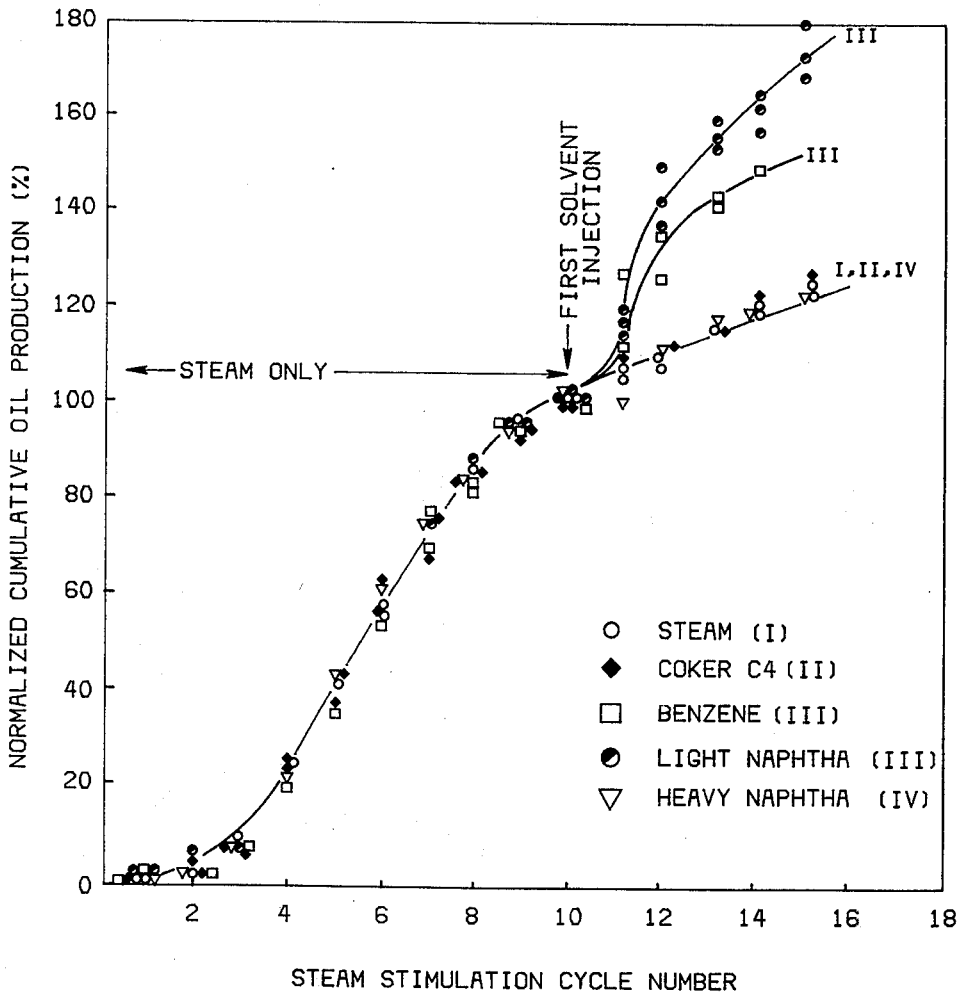
FIG. 3 is a plot which illustrates the increased oil recovery which is achieved by practicing this invention in comparison with conventional steam stimulation, and which also compares various solvents.

FIG. 3 is a plot of the normalized oil production from the laboratory model versus the injection cycle. Normalized oil production is defined as the cumulative oil produced after any given cycle divided by the cumulative production after ten cycles of steam stimulation. As demonstrated by the results plotted in FIG. 3, oil production per cycle initially increases as with increasing number of steam stimulation cycles, predominantly reflecting the fact that the volume of hot tar sands increases with each cycle. However, it is also apparent that with increasing number of cycles, the recovery via steam stimulation alone declines presumably because of the inherent deficiencies of the process which have been discussed above.

After 10 cycles of steam stimulation, a 1.5 PV% volume of light cracked naptha (13 LV% of the cumulative oil production to that point) was injected at the beginning of the 11th cycle. Upon completing the steam stimulation cycle, an immediate and significant increase in oil production was noted (see FIG. 3).

Typically, these experiments showed that up to about 5 volumes of bitumen can be recovered per volume of light naphtha solvent injected. The resultant incremental net oil recoveries on the order of up to 60% of the cumulative recoveries after 10 steam stimulation cycles were seen. The Class III solvents typified by light naphtha solvent are clearly superior to Class II solvents, Class IV solvents or steam alone and are therefore preferred.

Various modifications of this invention will be apparent to those skilled in the art without departing from the spirit of the invention. Further, it should be understood that this invention should not be limited to the specific experiments set forth herein.

What I claim is:

1. A process for recovering viscous oil from a subterranean deposit of a known temperature penetrated by a well which comprises cyclically injecting steam of a known temperature into and producing fluids from said deposit via said well until a steam chamber of substantial fluid mobility is established in said deposit adjacent to said well, said steam chamber having a residual viscous oil saturation therein, injecting a hydrocarbon solvent into said steam chamber prior to a subsequent steam stimulation cycle sufficient to reduce said residual viscous oil saturation upon conducting said subsequent steam stimulation cycle, said hydrocarbon solvent having a low concentration of low molecular weight paraffinic hydrocarbons and boiling for the most part less than said known steam temperature and for the most part greater than said known deposit temperature, and conducting said subsequent steam stimulation cycle to recover viscous oil from said deposit.

2. A process for recovering viscous oil from a subterranean reservoir of known temperature which is penetrated by a well in fluid communication therewith which comprises:

(a) injecting steam of known temperature into said reservoir via said well to heat said viscous oil reducing its viscosity sufficiently to mobilize at least a portion of said oil;

(b) producing mobilized oil via said well;

(c) repeating steps (a) and (b) until the oil production rate declines and a region having a mobile steam or steam condensate saturation and containing residual viscous oil has been created in said reservoir;

(d) injecting into said region via said well a hydrocarbon solvent capable of mobilizing said residual viscous oil, said solvent having a low concentration of low molecular weight paraffinic hydrocarbons and a boiling range for the most part less than said known steam temperature and for the most part more than said known reservoir temperature; and (e) repeating steps (a) and (b).

3. The process of claim 2 wherein said hydrocarbon solvent consists of a hydrocarbon mixture having a liquid volume percent residuum upon distillation of at least about 5% and as much as about 100% at a distillation temperature corresponding to the initial reservoir temperature, and a liquid volume percent distillation yield of at least about 5% and as much as about 100% at a distillation temperature corresponding to about 75% of the steam injection temperature.

4. The process of claim 2 wherein the quantity of solvent injected in step (d) equals about 5 liquid volume percent to about 15 volume percent of the cumulative volume of mobilized oil produced in step (c).

5. A method for recovering normally immobile viscous hydrocarbons from a subterranean deposit of known temperature penetrated by a well which comprises:

(a) injecting steam of known temperature into said deposit via said well, shutting in said well to permit heat to be transferred from said steam to said hydrocarbons to render them mobile, opening said well and producing mobilized hydrocarbons therethrough;

(b) repeating step (a) until a steam chamber greater than about 70 $m^3$ containing a mobile steam or steam condensate saturation and a residual viscous hydrocarbon saturation is created;

(c) injecting a slug of a hydrocarbon solvent to contact and reduce said residual viscous hydrocarbon saturation upon movement through said steam chamber, said solvent having a low concentration of low molecular weight paraffinic hydrocarbons into said deposit via said well, said solvent boiling for the most part less than said known steam temperature and for the most part more than said known deposit temperature; and (d) repeating step (a).

6. The method of claim 5 further comprising repeating steps (c) and (d) until the oil production rate is no longer efficient.

7. A method of recovering normally immobile hydrocarbons from a subterranean deposit penetrated by a well in fluid communication therewith which comprises:

(a) injecting steam into said well such that said deposit is heated and the viscosity of said hydrocarbons is sufficiently reduced to cause them to flow, then producing a portion of the mobilized hydrocarbons via said well;

(b) repeating step (a) until a region containing mobile steam or steam condensate and residual hydrocarbon has been established in said deposit adjacent to said well;

(c) injecting into said deposit via said well a hydrocarbon liquid to mobilize the residual hydrocarbons contained in said region, said liquid having a liquid volume percent residuum upon distillation of at least about 5% and as much as about 100% at a distillation temperature corresponding to the initial reservoir temperature, and a liquid volume percent distillation yield of at least about 5% and as much as about 100% at a distillation temperature corresponding to about 75% of the steam injection temperature, said liquid containing low concentrations of low molecular weight paraffinic hydrocarbons; and (d) repeating step (a).

8. The method of claim 7 wherein said hydrocarbon liquid is a light cracked naphtha distillation fraction boiling for the most part over 80°–350° F. temperature range.

9. A process for recovering bitumen from a tar sand deposit of a known temperature which is penetrated by a well which comprises:

(a) injecting steam of a known temperature into said deposit via said well, allowing heat from the steam to be transferred to the bitumen sufficient to mobilize a portion of said bitumen, and thereafter producing heated fluids including said mobilized bitumen via said well such that a substantial mobile steam or steam condensate region which contains residual amounts of bitumen is established in said deposit adjacent to said well;

(b) injecting a hydrocarbon solvent into said deposit via said well to mobilize a portion of said residual amounts of bitumen, said solvent containing a low concentration of low molecular weight paraffinic hydrocarbons and having a boiling point range for the most part less than said known steam temperature and greater than said known deposit temperature; and (c) injecting steam into said deposit via said well, permitting said deposit to soak, and producing heated fluids including mobilized residual bitumen via said well.

10. The process of claim 9 wherein at least 2000 liquid equivalent barrels of steam are injected in step (a).

11. The process of claim 9 wherein at least 500 barrels of bitumen are produced in step (a) prior to performing step (b).

12. The process of claim 9 further comprising repeating step (a) until a mobile steam or steam condensate region whose volume ranges from about 70 $m^3$ to about $34\times10^3$ $m^3$ is established.

13. The process of claim 9 wherein from about 2000 to about 60,000 liquid equivalent barrels of steam are injected in step (a).

14. The process of claim 9 wherein the amount of solvent injected in step (b) ranges from about 5 liquid volume percent to about 15 liquid volume percent of the volume of bitumen produced in step (a).

15. The process of claim 9 wherein said solvent is selected from the group consisting of light naphtha, gasoline, benzene, toluene and xylene.

16. The process of claim 9 wherein said solvent consists of a hydrocarbon mixture which, upon distillation, has a liquid volume percent residuum of at least about 5% at a distillation temperature corresponding to said known deposit temperature and a liquid volume percent yield of at least about 5% at a distillation temperature equalling about 75% of the steam injection temperature.

17. The process of claim 9 wherein said solvent is a mixed hydrocarbon fraction containing less than about 25 volume percent of paraffinic hydrocarbons having a molecular weight less than about 100.

* * * * *